United States Patent [19]

Urmston

[11] 3,938,455

[45] Feb. 17, 1976

[54] METHOD OF FORMING AND A CONSTRUCTION FOR A DIGITALLY OPENABLE CONTAINER CLOSURE

[75] Inventor: Hugh C. Urmston, Richmond, Ind.

[73] Assignee: Aluminum Company of America, Pittsburgh, Pa.

[22] Filed: Nov. 7, 1974

[21] Appl. No.: 521,692

Related U.S. Application Data

[60] Division of Ser. No. 357,937, May 7, 1973, which is a continuation-in-part of Ser. No. 281,541, Aug. 17, 1972, abandoned.

[52] U.S. Cl. ..... 113/121 C; 113/1 F; 113/15 A

[51] Int. Cl.[2] ..... B21D 51/26

[58] Field of Search ..... 113/15 R, 15 A, 121 C, 113/1 F; 220/266, 268, 276

[56] References Cited

UNITED STATES PATENTS

| | | | |
|---|---|---|---|
| 2,119,533 | 6/1938 | Fink | 220/276 |
| 2,159,325 | 5/1939 | Fabrice | 113/15 A |
| 2,187,433 | 1/1940 | Punte | 113/15 A |
| 2,434,375 | 1/1948 | Van Saun | 113/121 C |
| 3,227,304 | 1/1966 | Asbury | 220/268 |
| 3,362,569 | 1/1968 | Geiger | 220/268 |
| 3,410,436 | 11/1968 | Foss et al. | 215/249 |
| 3,411,470 | 11/1968 | Fraze | 113/121 C |
| 3,688,718 | 9/1972 | Schrecker | 113/15 A |
| 3,693,827 | 9/1972 | Baumeyer et al. | 113/15 A |
| 3,698,590 | 10/1972 | Cookson | 220/270 |

FOREIGN PATENTS OR APPLICATIONS

| | | | |
|---|---|---|---|
| 7,101,441 | 8/1971 | Netherlands | 113/121 C |

*Primary Examiner*—Michael J. Keenan
*Attorney, Agent, or Firm*—David W. Brownlee

[57] ABSTRACT

An improved method of forming and a construction for a digitally openable container closure. Included therein is a container wall having an inwardly displaceable opening panel defined by a fracturable web which has been formed by selectively displacing metal adjacent a predetermined line substantially perpendicular to the surface of the container wall and by extruding metal between substantially parallel die surfaces which are disposed at an angle to the plane of the container wall. Formed concurrently therewith is an integral inclined deflectable portion projecting outwardly from the container wall adjacent the fracturable web and which deflectable portion is adapted to effect, in response to digitally applied inwardly directed pressure, a relative displacement between the rim of the panel and the lip of the adjacent container wall to selectively strain the web and initiate fracture thereof to permit inward displacement of an opening panel of greater extent than the size of the opening formed in the container wall by the separation of said panel.

10 Claims, 10 Drawing Figures

METHOD OF FORMING AND A CONSTRUCTION FOR A DIGITALLY OPENABLE CONTAINER CLOSURE

BACKGROUND OF THE INVENTION

This is a division of pending application Ser. No. 357,937, filed May 7, 1973, which is a continuation-in-part of now abandoned application Ser. No. 281,541, filed Aug. 17, 1972.

This invention relates to metal container closures and more particularly to an improved method and apparatus for forming and construction for a digitally openable container end closure that not only exceeds the stringent and competitively dictated present day commercial economic and preformance criteria but also satisfies all ecology based governmental regulations now extant.

The metal container industry and its ever increasing demands for thin sheet metal has been one of the major motivating factors in both the growth and strength of our domestic economy. At the present day, for example, about 40 billion metal cans are fabricated each year alone to contain, preserve and transport beverages, such as soda and beer. Over the past 75 years or more, the ever increasing demands for product integrity backed up by governmental regulations and juridical pressures have, in an environment of continually increasing cost sensitivity, resulted in the development of commercially and competitively dictated interrelated economic and performance criteria of ever increasing stringency for metal containers. In the more recent years the competitive pressures attendant the fabrication of metal containers has been further complicated by the changing habits of the consumer and a marked increase in the long standing desire for metal containers that could be manually opened at the point of consumption without employment of auxiliary tools or the like. In the beverage field, such demand was recently satisfied, despite the existence of great numbers of suggested expedients therefor in the prior art and attendant unfavorable economic considerations, by the industry-wide fabrication of the Fraze type of pull tab easy open end closure. The widespread utilization of such type of end closures has, apart from the increased costs inherently attendant its fabrication due to increased metal content thereof and required multiple fabricating operations, created a serious ecology problem due to the hazards attendant the relatively sharp-edged removable tab portion thereof and the propensity of consumers to indiscriminately dispose of such tabs immediately following their separation from the container. In part, the problems attendant such indiscriminate tab disposition have resulted in the actual or contemplated banning of such closures in certain jurisdictions with the concommitant creation of problems of major magnitude for the can fabricators.

As noted above, the prior art, and notably the patentable art, is replete with hundreds of suggested expedients for achieving the long desired objective of simplified can opening, including many suggested expedients for can closures that can be digitally opened, i.e., manually opened without the use of auxiliary tools or the like. Included in such expedients were the use of container walls and end closures which included weakening lines or score lines defining tear strips or panels which could either be depressed into or pried out of a container to form either a vent or a pouring opening therein. Closures of this type are exemplarily disclosed in a number of United States patents including Newman U.S. Pat. No. 1,805,003, Fried U.S. Pat. No. 2,176,898, Asbury U.S. Pat. No. 3,227,304, Asbury U.S. Pat. No. 3,246,791, Asbury U.S. Pat. No. 3,355,058, Klein et al U.S. Pat. No. 3,334,775, Foss et al U.S. Pat. No. 3,410,436, Punte U.S. Pat. No. 2,187,433, Punte U.S. Pat. No. 2,289,452, Punte U.S. Pat. No. 2,312,358, Punte U.S. Pat. No. 2,312,359, Fink U.S. Pat. No. 2,119,533 and Punte U.S. Pat. No. 2,120,186. Such end closures have sometimes required the use of rigid tools, such as a coin or a fork, to rupture the score line around the removable panel in order to form an opening in the end closure. Several of such end closures have included embossments in the removable portion to facilitate opening of the removable portion by pressing or prying against such embossments.

It has also been suggested to form a weakening line in the form of a fracturable web in such a container closure by displacing metal along one side of a line at right angles to the initially undisplaced surface of the container wall in such a way that the edge defining the periphery of the removable wall portion underlaps the corresponding edge of the non-removable wall portion and has an abrupt change in cross-sectional wall thickness as is disclosed in Geiger U.S. Pat. No. 3,362,569. That patent discloses that the removable wall portion in such a closure has greater resistance against severance of the fracturable web as would be occasioned by internal pressure than it has against severance due to an opening force applied against the exterior surface of the portion. It has been found, however, that displacing metal at right angles to the surface of the sheet in the manner taught and disclosed in Geiger U.S. Pat. No. 3,362,569 can cause small cracks in, or accidental severance of, the fracturable web that is formed, particularly in hard temper metal. Punte U.S. Pat. No. 2,187,433 suggests another expedient wherein a weakened thinned portion is formed in a container wall by thinning the wall between a rounded corner of a movable die member and a die surface disposed at a 45° angle to the axis of displacement of the movable die member. Other expedients suggested by the art for the formation of particularly shaped weakened areas are embodied in United States patents to Barrath U.S. Pat. No. 540,625, Fraze U.S. Pat. No. 3,291,336, Cookson U.S. Pat. No. 3,434,623, Cookson U.S. Pat. No. 3,698,590 and Baumeyer et al U.S. Pat. No. 3,693,827.

Insofar as I an aware, none of these suggested expedients have apparently been able to satisfy the strigent and complementally interrelated economic and performance criteria necessary for widespread use on beverage and like containers. As evidenced by the span of years covered by the above noted patents, it has long been desired to have a container end closure or container wall with a removable portion in it which can be inwardly displaced from the end closure or wall without need for a separate tool or a pull tab attached to the removable portion. While the Fraze type of pull tab easy open end closure is, as noted above, presently in wide use despite its additional expense, the current ecology induced pressures make it desirable to utilize the concepts of the Geiger patent, but to provide a method of forming a fracturable web that is not subject or vulnerable to small cracks or failure therein and which satisfies the current strigent and complementally interrelated economic and performance criteria necessary for widespread commerical use.

SUMMARY OF THE INVENTION

This invention may be briefly described as including, in its broad aspects, the provision of an improved method and apparatus for forming and construction for a digitally openable container end closure. In such broad aspect it includes a container wall having a particularly contoured fracturable web defining an inwardly displaceable opening panel having an upper surface on the rim thereof intersecting the inner marginal edge of the lip of an adjacent particularly contoured deflectable portion in a first exposed corner and with the undersurface of said lip disposed in substantial alignment with said upper surface of said panel rim and intersecting the outer marginal edge of said rim in a second corner. The deflectable portion is integral with the container wall and projects outwardly from the plane of the container wall adjacent the fracturable web and is adapted to effect, in response to digitally applied inwardly directed pressure thereon, relative displacement of the lip and rim to strain the web and initiate fracture thereof.

In its narrower aspects the invention includes the formation of a fracturable web by moving metal adjacent a predetermined line substantially perpendicular to the surface of the sheet while squeezing a zone of metal along such line between substantially parallel die surfaces which are disposed at an angle to the plane of the container wall. Such squeezing of the container wall along the zone of metal extrudes metal laterally from such line to produce a bulge forming at least a part of said deflectable portion in the container wall which can be flexed to cause relative movement of the metal on opposite sides of the fracturable web and thereby facilitate initiation of rupture thereof.

Among the advantages of the subject invention are the provisions of a metal container closure construction that exceeds the stringent present day interrelated commercial economic and performance criteria and which also satisfies current ecology based governmental regulations. More specific advantages include the provision of a highly reliable end closure of markedly reduced metal content that can be fabricated with a minimal number of fabricating steps at extremely high production rates with simple tooling. Further advantages include the provision of an end closure that can be opened by application of modest amounts of digitally applied pressure without the use of auxiliary tools and the overcoming of ecology based objection to present day Fraze type severable pull tab closures through inward displacement of a closure panel sized to be larger than the resulting opening in the container wall.

The object of this invention is the provision of an improved method and apparatus for forming and construction for a digitally openable container end closure.

Accordingly, another object of the invention is to provide a tabless container wall which can be opened with the fingers.

Another object of the invention is to provide a method of forming a container wall with a fracturable web in it which can be easily ruptured when force is applied against one surface of the container wall.

Another object of the invention is to provide a method of forming a fracturable web in a container wall by displacing metal at right angles to the plane of the container wall while squeezing a zone of metal to prevent complete severance of the container wall during such displacement of metal.

A further object of the invention is to provide a method of deforming a sheet of metal to provide a selectively contoured fracturable web that can be ruptured without the need for a special tool or a pull tab attached to the severable portion of the sheet.

Another object of the invention is to provide a container wall with a fracturable web in it defining a removable panel and an adjacent flexible or deflectable bulge for displacing portions of the container wall to facilitate initiation of rupture of the web.

Another object of the invention is to provide a container wall with a fracturable web in it defining a removable panel with an edge portion of the removable panel and an adjacent edge portion of the container wall lying in substantially parallel planes, and further including a deflectable bulge in the container wall for selectively displacing portions of the container wall to cause relative movement of the metal on opposite sides of the fracturable web to initiate rupture or fracture of the web.

BRIEF DESCRIPTION OF THE DRAWINGS

The above and other objects and advantages of the invention will be more fully understood and appreciated with reference to the following description and the drawings appended hereto wherein.

DESCRIPTION OF PREFERRED EMBODIMENTS

Figure 1:
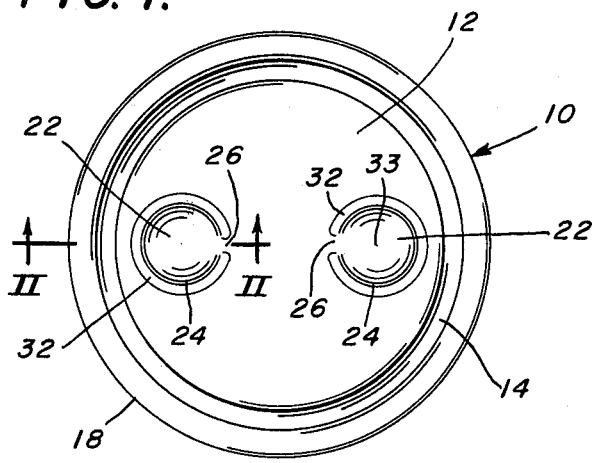
FIG. 1 is a plan view of a can end of the invention.
Figure 2:
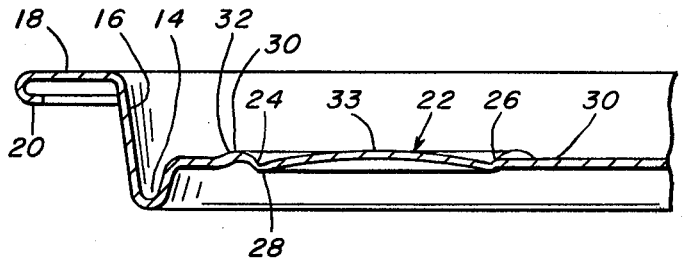
FIG. 2 is an enlarged cross section through the can end of FIG. 1 taken along line II—II.

Referring to FIGS. 1 and 2, a container wall or can end 10 is shown which includes a substantially planar central panel 12, a peripheral groove 14 around the panel, an upstanding wall 16 outwardly of the groove, a flange 18 extending outwardly from the top of the upstanding wall and a curled edge 20 on the outer end of the flange. Such general construction of a peripherally chimed can end is typical of can ends which are adapted to be sealed on container bodies by conventional double seaming operations.

In order to facilitate understanding of the subject invention and in the interest of clarity, the terms "inwardly" and "outwardly" will be herein employed to delineate directions relative to the interior and exterior respectively of a cylindrical container having the end closure of interest mounted on the end thereof.

In accordance with this invention, can end 10 further includes at least one, and preferably two, inwardly displaceable opening panels 22 of equal size defined by weakening lines 24 in the form of fracturable webs in central panel 12. Panels 22 are designed to be opened by displacing them into a container on which can end 10 is sealed to form a pouring opening and/or a vent in the can end. In the embodiment selected for illustration in FIGS. 1 through 4, each fracturable web 24 may be C-shaped with a bridge of metal between the ends of the line providing a hinge 26 which prevents complete separation of the opening panel 22 from container end 10. Hinge 26 between the ends of the fracturable web 24 may be slightly weakened by a shallow score line or the like, but may also be unweakened for some applications. In case of accidental rupture of the web 24 due to excessively high internal pressures in a container, hinge 26 will prevent complete separation of a removable panel 22 from can end 10. Hinge 26 also normally prevents the panel 22 from dropping into the container after inward displacement thereof.

It is a feature of a container end constructed in accord with the principles of this invention that at least a marginal edge portion 28 of opening panel 22 adjacent the fracturable web 24 be disposed with respect to an adjacent marginal edge portion 30 of central panel 12 on the other side of the web such that opposite faces of such two marginal edge portions 28 and 30 are disposed in nearly the same plane. In the embodiment selected for illustration in FIGS. 1–4, such displacement results in the top surface of the edge portion 28 of the opening panel 22 being disposed in nearly the same plane as is the bottom surface of edge portion 30 of the adjacent portion of central panel 12 disposed on the other side of the fracturable web.

Figure 9:
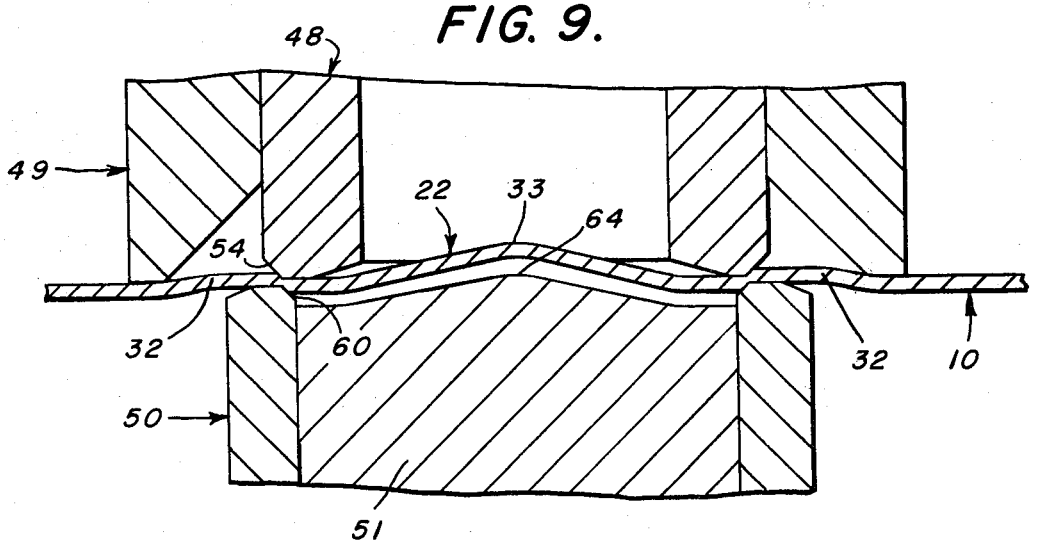
FIG. 9 is a cross sectional view similar to FIG. 7 illustrating further displacement of the die members in the formation of a fracturable web in a container wall.

It is another feature of this invention that the central panel 12 has a bulge or bulges formed in it adjacent the fracturable web 24 as is best illustrated in FIGS. 2 and 9. As will be explained, flexing or other digitally induced displacement of such bulge or bulges, which constitute at least part of a deflectable portion of the container wall, facilitates rupture of the web 24 by producing relative movement of metal on opposite sides of the web to strain the residual metal and initiate its failure. In can end 10, a bulge 32 may be formed adjacent removable panel 22 or a bulge 33 may be formed within the opening panel 22, as will be described.

Depending on the intended use of a container end e.g. on pressurized or unpressurized cans or on automatically ventable cans; the adjacent portions of metal on opposite sides of the fracturable web 24 and the flexible deflectable portions 32 and 33 may be formed either outwardly or inwardly directed with respect to the initially undisplaced metal in the container wall. In the can end 10 illustrated in FIGS. 1–4, which is adapted to be sealed on a container for holding relatively high internal pressures, the marginal edge portion 28 of opening panel 22 has preferably been displaced downward with respect to the adjacent portion 30 of central panel 12 on the opposite side of the fracturable web so that the web will have a greater resistance against rupture due to internal pressure in the container than it will have against rupture due to external pressure applied against opening panel 22. The difference in resistance to rupture of a weakening line depending on the direction of force was previously broadly disclosed in the Punte and Geiger U.S. Pat. Nos. 2,187,433 and 3,362,569, and is believed to result from an overlap of metal on opposite sides of a weakening line.

Figure 3:
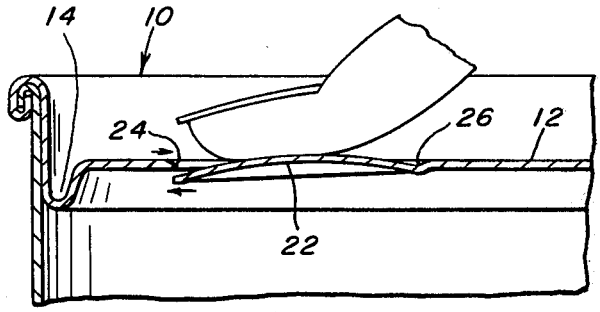
FIG. 3 is an enlarged cross sectional view of a can end of the invention seamed on a container and illustrating finger pressure applied to an outwardly domed or bulged panel to initiate rupture of the fracturable web in the can end.
Figure 4:
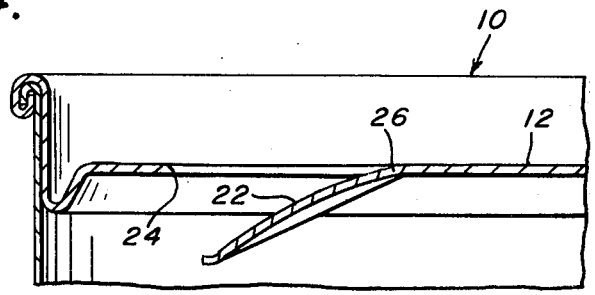
FIG. 4 is a section view similar to FIG. 3 and showing the can end after opening.

Deflectable portion 32 is preferably formed outwardly with respect to the initially undisplaced surface of can end 10 so that finger pressure applied against opening panel 22 or more desirably against said deflectable portion 32 will cause flexing and selective displacement thereof to facilitate initial fracture of the web 24 as will now be explained. As illustrated in FIG. 3, depressing the illustrated outwardly domed opening panel 22 causes flexing and displacement of at least portions of central panel 12. While not fully understood at the present time, it is believed that this flexing of portions of central panel 12 causes relative movement of adjacent portions of metal on opposite sides of the fracturable web 24 to thereby stress and fracture the thin residual of metal constituting such web. Such flexing displacement of portions of container panel 12 is also believed to cause some bending of the thin residual of metal constituting the web to further contribute to the initiation of fracture thereof. As opening panel 22 is further depressed, the web 24 around the panel 22 continues to separate so that the panel may be hinged inwardly into the container as illustrated in FIG. 4. When both panels 22 have been so opened, one opening can be used for pouring or drinking from the container, and the other opening will vent air into the container.

Figure 5:
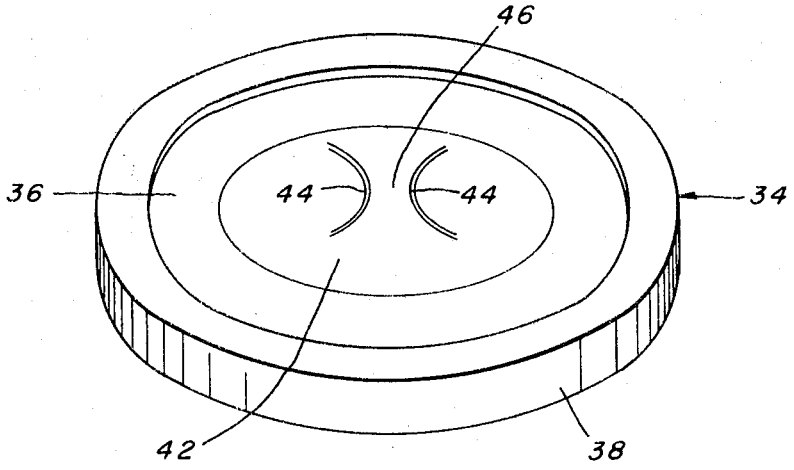
FIG. 5 is a perspective view of an alternative embodiment of a closure of the invention.
Figure 6:
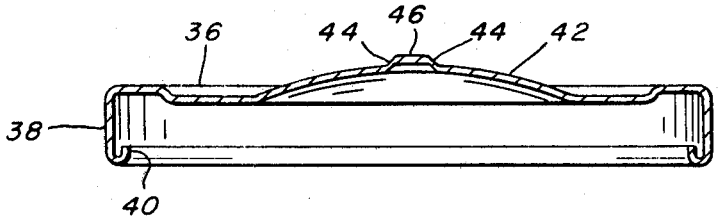
FIG. 6 is a cross section through the closure of FIG. 5.

FIGS. 5 and 6 illustrate another embodiment of a closure incorporating the principles of this invention which is particularly adapted for closing a bottle or other container for food which may be vacuum packed. Closure 34 includes an end wall 36, a peripheral skirt 38 with a curled edge 40 thereon for engaging under a retaining bead or lugs on a container. In accordance with this invention, closure 34 further includes an upwardly domed deflectable button 42 in end wall 36 and two fracturable webs 44 formed in the button near its top. Fracturable webs 44 may be arcuate in shape and concave toward the periphery of the closure leaving a bridge 46 of unweakened metal between the fracturable webs. In this embodiment of the invention, the metal between the fracturable webs 44 is preferably displaced outwardly with respect to adjacent metal on the opposite sides thereof as illustrated in FIG. 6.

When it is desired to open a container on which closure 34 is sealed, bridge 46 may be inwardly displaced to cause failure of at least one of webs 44 and thereby release the vacuum in the container. Releasing the vacuum in a container on which closure 34 is sealed will obviously facilitate removal of the closure from the container by freeing the closure to be more easily moved with respect to the container. It is believed that inward displacement of bridge 46 causes relative movement of metal on opposite sides of fracturable webs 44 to stress the thin residual of metal in the web and thereby facilitate initiation of its rupture.

Figure 7:
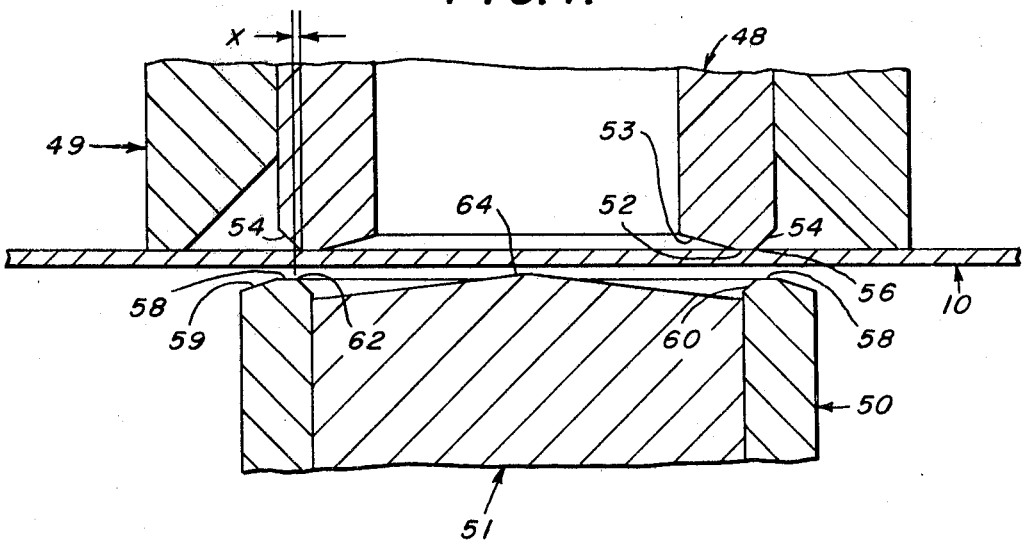
FIG. 7 is a cross section illustrating tools for deforming a container wall in accordance with the invention.
Figure 8:
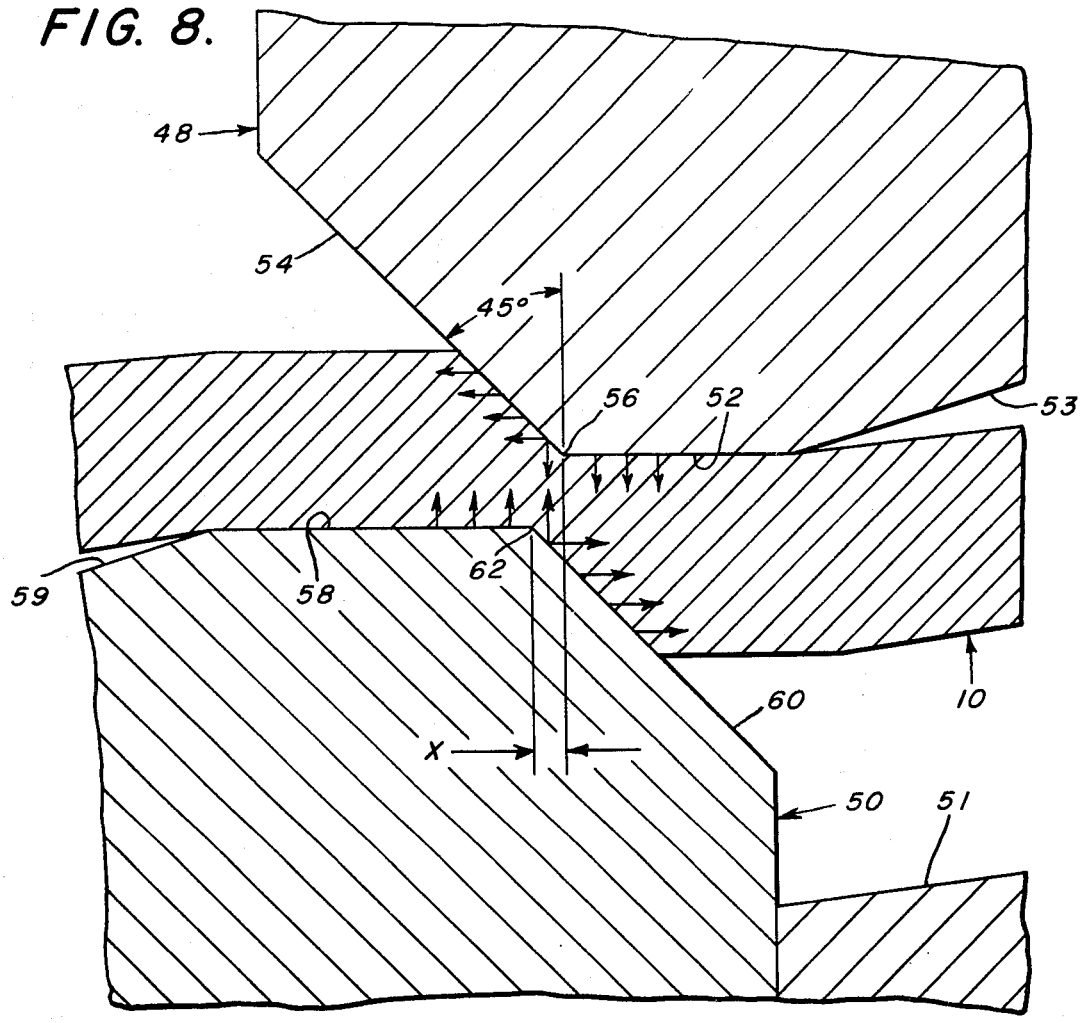
FIG. 8 is an enlarged cross sectional view of a portion of the tools from FIG. 7 illustrating an intermediate stage in the forming of a fracturable web in a container wall.

FIGS. 7, 8 and 9 illustrate exemplary tools and a preferred method for forming the particularly contoured fracturable web in accordance with the invention. Such exemplary tools comprise an annular top die 48 and an annular bottom die 50 between which a sheet metal container wall 10 is introduced to have the fracturable web formed therein, an auxiliary outer die means 49 and an optionally employable inner doming tool 51 for controlling the direction in which deflectable portion 32 and domed opening panel 22 are formed in the container wall. Top die 48 has a first substantially planar horizontal bottom face or base surface 52, an inner face 53 inclined upwardly from base surface 52 to permit the formation of an upwardly domed opening panel, and a second and angularly disposed substantially planar metal extruding surface or face 54 which preferably extends outwardly from the first base surface at approximately a 45° angle, although limited angular departure therefrom may apparently be tolerated. The first base surface 52 and second metal extruding surface 54 of die 48 meet at a relatively sharp corner 56 so that a similar sharp corner will be formed in container wall 10. Preferably the corner 56 between the first and second die surfaces 52 and 54 has a radius of less than 0.001 inch, but may tolerate a radius, as for example as would be occasioned by wear, of up to about 0.005 inch on tools for forming a fracturable web in rigid aluminum alloy container sheet having a thickness in a range of 0.010 inch to 0.015 inch which is typical of sheet used in the production of can ends.

Bottom die 50 has a first substantially planar base surface or top face 58, a downwardly inclined outer face 59 to permit the formation of a deflectable portion 32 externally adjacent the opening panel 22 and a second and angularly disposed substantially planar metal extruding surface or inner face 60 extending downwardly from the first base surface 58 at approximately a 45° angle. Base surface 58 and metal extruding surface 60 also preferably meet at a relatively sharp corner 62 as do the die faces in top die 48. Metal extruding surfaces 54 and 60 on top and bottom dies 48 and 50 are preferably substantially parallel, although limited departure therefrom can apparently be tolerated. Inner doming tool 51 may further have an upwardly projecting dome 64 on it to form an outwardly domed opening panel 22 which can be concurrently formed therewith. The auxiliary die means 49 and inner doming tool 51 may be integral parts of tools 48 and 50 respectively, or for ease of fabrication may be separate parts as illustrated, but are preferably moved as unitary assemblies during practice of the invention. Inner doming 51 may be omitted from the tools where the presently preferred inwardly domed opening panel 22 is to be formed.

Auxiliary outer die means 49 is disposed on the same side of container wall 10 as is upper die member 48 and has a metal shaping base surface 49*a* facing the same general direction as does first base surface 52 of upper die member 48 and is in laterally spaced relation with the first base surface 58 on the lower die member 50.

As tools 48, 49, 50 and 51 (when included) are moved against container wall 10 which has been introduced between the dies, metal from the container wall is first drawn or stretched over dome 64 on inner doming tool 51. As the dies continue to close, the first base surface 52 and the second metal extruding surface 54 of the top die member 48 are lineally displaced toward the second angularly disposed metal extruding surface 60 and first base surface 58 respectively of the second die member 60 and with the corners 56 and 62 being maintained in laterally spaced relation as described above. Following initial engagement of the top die member 48 with interposed metal sheet, metal from container wall 10 begins to be displaced or moved by the base die surfaces 52 and 58 substantially perpendicular, or at right angles, to the initially undisplaced surface of the container wall. When base die surfaces 52 and 58 have closed to within approximately three-fourths to two-thirds of the thickness of container wall 10, metal begins to be extruded from between the angularly offset metal extruding surfaces 54 and 60 on the dies. Up to that point, the metal in container wall 10 is merely reformed around corners 56 and 62 on the dies.

As dies 48 and 50 continue to close with respect to one another, metal in container wall 10 is squeezed between the metal extruding surfaces 54 and 60 of the dies to cause lateral flow or extrusion of metal away from the fracturable web while metal is also being displaced at substantially right angles to the initially undisplaced surface of the container wall. The described lineal displacement of the top die member 48 toward the lower die member 50 continues until the first base surface 52 thereof is disposed substantially coplanar with the first base surface 58 of the lower die member 50. It is believed that this lateral flow or extrusion of metal away from the fracturable web which is being formed is important in preventing cracks from forming in, and premature severance of the web. In the absence of such extrusion, metal may be sheared or cut by the tools as is done in typical blanking or punching operations in which the metal is separated or sheared along the line of the tools before the dies have completely penetrated the metal. The present invention substantially eliminates the formation of cracks or failures in the fracturable web because metal is extruded laterally away from the web during the right angle displacement of metal to cause lateral flow of metal approximately as fast as the metal is being displaced at right angles so that the metal is not sheared or separated by such right angle displacement. Experience to date indicates that in the practice of this invention, container ends of the type disclosed can be formed at high rates of press operation to produce 300 or more ends per minute per die set up with few or no defective can ends.

Lateral metal flow away from the fracturable web that is being formed also produces an increasing surface area of metal in a can end for forming the desired deflectable portion in the metal adjacent the web. As explained above, such deflectable portion 32 is believed to facilitate rupture of the fracturable web. In the tools illustrated in FIGS. 7–9, the auxiliary die means 49 and the inner doming tool 51 respectively control the direction in which the increased area of metal is formed so that deflectable portion 32 and domed opening panel 22 project outwardly with respect to the original undisplaced surface of the can end. Obviously, for other can ends or closure applications, similar tools could also control the metal working so that the bulges or deflectable portions would be formed downward (i.e., inwardly) on one or both sides of the fracturable web if desired.

After inner doming tool 51 has initiated outward doming of opening panel 22, lateral extrusion of metal produced by the formation of fracturable web 24 further domes the opening panel so that the metal in the panel is spaced above dome 64 on the doming tool 51 as is illustrated in FIG. 9. Auxiliary die means 49 controls the formation of the preferred outwardly projecting deflectable portion 32 adjacent the fracturable web 24 by restraining the metal distal the fracturable web so that the metal bows upward over bottom die 50 as is also illustrated in FIG. 9. In forming the deflectable portion 32, the auxiliary die means 49 is lineally displaced to selectively move the base surface 49*a* thereof into predetermined longitudinally offset relations with the first base surface 58 of lower die member 50 in the direction of die displacement.

It is believed that lateral extrusion of metal during formation of the particularly contoured fracturable web 24 in accordance with the principles of this invention results in the formation of complex residual stresses in the web probably having a substantial component thereof in shear which may interact with the stresses produced by inward displacement of the deflectable portions to contribute in initiating rupture of the fracturable web. Such residual stresses apparently act within the fracturable web 24 to make it easier to initiate its rupture.

In the practice of this invention, the amount of lateral spacing $x$ between the corners 56 and 62 in the horizontal direction may vary depending upon the alloy, temper and thickness of the metal in container wall, the angle of the metal extruding surfaces 54 and 60, and the residual thickness of metal to be left in the fracturable web among other factors. Such lateral spacing is preferably in the range of one-fourth to one-sixth of the thickness of the container wall in which the fracturable web is formed, but may be from 5% to 50% of the metal thickness for some applications. In the exemplary practice of the invention, an overlap $x$ of die surfaces 54 and 60 of approximately 0.0032 inch has been found to work well in forming a fracturable web in a container wall made from a sheet of hard temper aluminum base alloy 0.013 inch thick. In that example, the dies were moved toward one another until base surfaces 52 and 58 were within approximately 0.001 inch of coplanar orientation. This produced a fracturable web with a thin residual of metal approximately 0.004 inch thick with no cracks therein.

Figure 10:
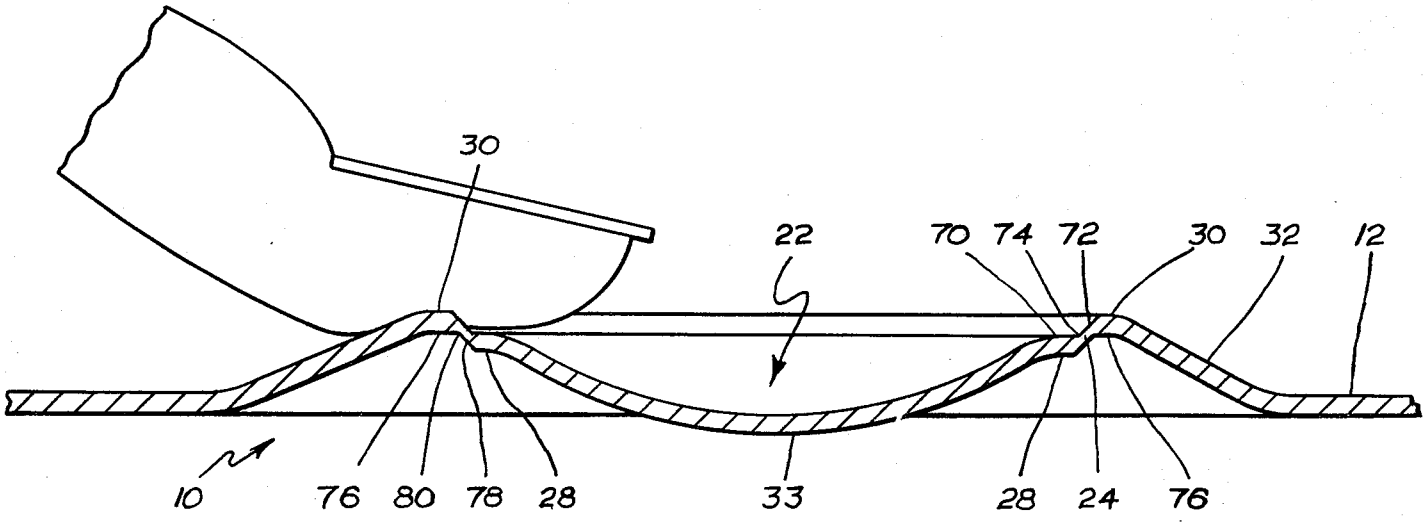
FIG. 10 is an enlarged cross sectional view of a portion of a presently preferred embodiment of a container wall constructed in accordance with principles of the invention.

FIG. 10 illustrates a presently preferred configuration of a metal end closure incorporating the principles of this invention. There is provided a central panel 12 having at least one circular and relatively rigid opening panel 22 contoured to include an inwardly domed center portion 33 bounded by a rim 28 peripherally terminating in a fracturable web 24. The web 24 interconnects the rim 28 with a lip 30 of an integral outwardly projecting deflectable portion 32 of generally frustoconical configuration surrounding the opening panel 22 in the adjacent portion of the container wall. Preferably, rim 28 has a substantially planar upper surface 70 which terminally intersects an angularly inclined surface 72 defining the inner marginal edge of lip 30 of deflectable portion 32 in an exposed corner 74. Lip 30 has a substantially planar undersurface 76 disposed in substantially coplanar relation with the upper surface 70 of rim 28 and which terminally intersects an angularly inclined surface 78 defining the outer marginal edge of the rim 28 of the panel 22 in a second corner 80. The corners 74 and 80 are disposed in predetermined laterally spaced relation and define therebetween the lateral extent of the fracturable web 24.

Deflectable portion 32 in container end 10 is adapted to effect, in response to inwardly directed digitally applied pressure a relative displacement of lip 30 with respect to rim 28 to strain fracturable web 24 and initiate fracture thereof to permit inward displacement of a separated opening panel of greater rim size than the size of the opening which is formed in the end. Such inwardly directed digital pressure is best applied against the end 10 adjacent web 24 and preferably against the raised lip 30 of the deflectable portion 32 as is illustrated in FIG. 10. Such inward pressure against the deflectable portion 32 appears to move the lip 30 relative to the rim 28 of the relatively rigid opening panel 22 to strain the fracturable web 24 and initiate fracture thereof. As pointed out above, the opening panel 22 is preferably of relatively rigid character to resist bending thereof and thereby insure that the displacement of the deflectable portion 32 will create sufficient relative displacement of the lip 30 thereof with respect to the rim 28 of the opening panel 22 to initiate web fracture. The lateral spacing corners of 74 and 80 are selected to define a web of at least a predetermined minimal extent sufficient to maintain its structural integrity during exposure to variations in the magnitude of the residual stress therein occasioned by normal container handling and usage and less than a predetermined maximum extent that would preclude said displacement induced fracture thereof in response to said digitally applied inwardly directed pressure.

While the mechanics underlying the mode of operation of the subject construction are not well understood at the present time, it is believed that complex residual stresses are introduced into the particularly contoured fracturable web by the metal displacement effected during the formation thereof. It is further believed that the relative displacement of the deflectable portion induced by the inwardly directed digitally applied pressure introduces a further complex stress pattern of varying character into said web and that localized web fracture is initiated by selectively located and probably localized interactions thereof with the formation-created residual stresses extant therein.

It is therefore seen that a container wall and a method of forming the same are provided which offer improved opening characteristics and improved resistance to the formation of cracks in the fracturable web in the container wall. Metal is moved substantially at right angles to the initially undisplaced surface of the container wall along the fracturable web while metal is extruded laterally away therefrom. The extrusion of metal causes lateral metal flow which is approximately as fast as the right angle displacement of metal during at least the latter part of the forming operation to thereby avoid shearing the metal, and further forms a deflectable portion in the container wall whose digitally induced displacement initiates web fracture.

The invention is particularly well suited for use with container walls made of work hardened aluminum base alloy sheet material in the thickness range of 0.010 inch to 0.015 inch and which is at least quarter hard, and preferably at least three-quarter hard temper or is of extra hard temper alloy which has been partially annealed as a result of heating it to cure a protective coating thereon. Quarter hard aluminum alloy sheet will generally have a yield strength which is at least one-half the yield strength for the same alloy in a full hard condition, and two or more times the yield strength for the product in a fully annealed or recrystallized condition. It is believed that such work hardened alloy sheet material is particularly well suited to practice of the invention because material of the specified hardness is required to assure conversion of the inwardly directed digitally applied pressures into selectively directed displacement of the lip of the deflectable portion relative to the rim of the relatively rigid opening panel. It is further believed that work hardened aluminum alloy will also result in the presence of greater residual stresses in the metal, both as to those introduced in the initial formation of the fracturable web and those introduced by relative metal displacement as described above.

Experience to date has indicated that opening panels having diameters in the range of about one-eighth inch to three-quarters inch provide adequate pour and venting rates and also result in adequate lateral metal extrusion during forming to produce deflectable portions of desired size and configuration. With respect to such deflectable portions, it is believed that an angle inclination in a range of about 5° to 15° to the general plane of an end closure provides an adequate toggle-like action to effect the necessary displacement of the lip portion relative to the opening panel rim portion to initiate web fracture.

Although a preferred embodiment of a container wall and a preferred method and apparatus for forming the same have been illustrated and described, it will be apparent to those skilled in the art that numerous variations could be made therein without departing from the invention.

What is claimed is:

1. In the formation of a sheet metal container component having at least one inwardly displaceable opening panel and an outwardly projecting deflectable portion disposed in integral interconnected relation therewith by a selectively shaped, residually stressed, fracturable web, the steps of introducing a sheet of metal intermediate a first die member having a first substantially planar surface and a second and angularly disposed substantially planar metal extruding surface defining therewith a first obtuse corner at the locus of intersection therebetween and a second and correspondingly shaped die member having a first substantially planar base surface and a second and angularly disposed substantially planar metal extruding surface defining therewith a second obtuse corner at the locus of intersection therebetween, and with auxiliary die means disposed on the same side of the sheet as said first die member having a metal shaping base surface facing the same general direction as does said first surface of said first die member and in laterally spaced relation with said first surface of said second die member; lineally displacing said first die member towards said second die member to selectively move said first and second surfaces of said first die member into operative proximity with said second and first surfaces respectively of said second die member with said first and second corners of said die members laterally spaced from each other, and thereby engage said sheet to displace portions of the surface of said sheet at substantially right angles to the initially undisplaced surface thereof by action of said first planar surface of said first and second die members, and laterally extrude portions of said sheet within the locus of displacement thereof through the conjoint action of said first and second surfaces of said first and second die members to form said fracturable web, stopping said die member displacement when said first planar surface of said first die member is disposed substantially coplanar with said first planar surface of said second die member, and lineally displacing said auxiliary die means towards said second die member to selectively move said base surface thereof into predetermined longitudinally offset relation with said first surface of said second die member in the direction of die displacement to form said deflectable portion by the conjoint action thereof.

2. A method as set forth in claim 1 wherein said first die member and said auxiliary die means are lineally displaced against the upper surface of said container component to form a substantially planar upper surface on the rim of said opening panel which is substantially coplanar with a substantially undersurface on the inner lip of said deflectable portion.

3. A method as set forth in claim 1 wherein a sheet of at least three-quarter hard temper aluminum alloy is introduced intermediate said first and second die members which are closed against said sheet.

4. In the formation of a sheet metal container component having at least one inwardly displaceable opening panel and an outwardly projecting deflectable portion disposed in integral interconnecting relation therewith by a fracturable web, the steps of introducing a sheet of metal intermediate a first die member having a first substantially planar metal extruding surface and a second and angularly disposed substantially planar metal extruding surface defining therewith a corner at the locus of intersection therebetween, and a second die member having a first base surface and a second and angularly disposed metal shaping surface, and with auxiliary die means disposed on the same side of the sheet as said first die memer having a metal shaping base surface facing a generally opposite direction from said first surface of said second die member and in laterally spaced relation therewith; lineally displacing said first die member towards said second die member to selectively move said first and second surfaces of said first die member into operative proximity with said surfaces of said second die member to engage said sheet and laterally displace portions thereof within the locus of displacement of said die surfaces by the conjoint action of said first and second surfaces of said first and second die members to form said fracturable web, stopping said die member displacement when the apex of said corner on said first die member is disposed in substantial alignment with said first surface of said second die member, and lineally displacing said auxiliary die means towards said second die member to selectively move said base surface thereof into predetermined longitudinally offset relation with said first surface of said second die member in the direction of die displacement to form said deflectable portion by the conjoint action thereof.

5. Apparatus for forming a sheet metal container component having at least one inwardly displaceable opening panel and an outwardly projecting deflectable portion disposed in integral interconnected relation therewith by a selectively shaped, residually stressed, fracturable web, comprising a first die member having a first substantially planar base surface and a second and angularly disposed substantially planar metal extruding surface defining therewith a first obtuse corner at the locus of intersection therebetween, a second and correspondingly shaped die member having a first substantially planar base surface and a second and angularly disposed substantially planar metal extruding surface defining therewith a second obtuse corner at the locus of intersection therebetween, and auxiliary die means having a metal shaping base surface facing in the same general direction as the first surface of said first die member and disposed in laterally spaced relation with said first surface of said second die member, said first die member and said auxiliary die means being lineally displaceable relative to said second die member with said first and second surfaces of said first die member in generally opposed relation with said second and first surfaces respectively of said second die member, and with said first and second corners of said die members laterally spaced from each other, whereby displacement of said die members and said auxiliary die means against a sheet of metal positioned therebetween to a closed die position in which said first planar surface of said first die member is substantially coplanar with said first planar surface of said second die member and said base surface of said auxiliary die means is in longitudinally offset relation with said first surface of said second die member in the direction of die displacement will displace portions of the surface of said sheet at substantially right angles to the initially undisplaced surface thereof by action of said first planar surfaces of said first and second die members, and will laterally extrude portions of said sheet within the locus of displacement thereof through the conjoint action of said first and second surfaces of said first and second die members to form said fracturable web, and will form said deflectable portion by the conjoint action of said first surface of said second die and said base surface of said auxiliary die means.

6. Apparatus as set forth in claim 5 wherein said die members and die means are of generally circular configurations in concentric relation with one another.

7. Apparatus as set forth in claim 5 wherein at least one of said first or second corners of said die members is interrupted at a location on the perimeter of the die members to form a hinge element on said displaceable panel having a greater thickness than said fracturable web.

8. Apparatus as set forth in claim 5 wherein each of said second surfaces of said first and second die members is disposed at an angle of about 45° to said first surfaces of said dies to extrude metal between said second surfaces at about 45° angle to the initially undisplaced surface of said sheet of metal.

9. Apparatus as set forth in claim 5 wherein said first and second corners of said die members are laterally spaced less than 0.004 inch.

10. Apparatus for forming a sheet metal container component having at least one inwardly displaceable opening panel and an outwardly projecting deflectable portion disposed in integral interconnected relation therewith by a fracturable web, comprising a first die member having a first substantially planar metal extruding surface and a second and angularly disposed substantially planar metal extruding surface defining with said first surface a corner at the locus of intersection therewith, a second die member having a first base surface and a second and angularly disposed metal shaping surface, an auxiliary die means having a metal shaping base surface facing in a generally opposite direction from said first surface of said second die member and in laterally spaced relation therewith, said first die member and said auxiliary die means being lineally displaceable relative to said second die member with said first and second surfaces of said first die member in generally opposed relation with said first and second surfaces of said second die member, whereby displacement of said die member and said auxiliary die means against a sheet of metal positioned therebetween to a closed die position in which said apex of said corner on said first die member is in substantial alignment with said first surface of said second die member and said base surface of said auxiliary die means is in longitudinally offset relation with said first surface of said second die member in the direction of die displacement will laterally displace portions of said sheet within the locus of displacement of said die surfaces through the conjoint action of said first and second surfaces of said first and second die members to form said fracturable web, and will form said deflectable portion by the conjoint action of said first surface of said second die and said base surface of said auxiliary die means.

* * * * *